US006624836B2

(12) United States Patent
Sakuta et al.

(10) Patent No.: US 6,624,836 B2
(45) Date of Patent: Sep. 23, 2003

(54) INK CASSETTE, INK RIBBON CONTAINER, AND METHOD OF ATTACHING INK RIBBON TO INK CASSETTE

(75) Inventors: Akira Sakuta, Tokyo (JP); Toshiyuki Toyofuku, Tokyo (JP); Hiroyuki Kaneko, Tokyo (JP)

(73) Assignees: Mitsubishi Denki Kabushiki Kaisha, Tokyo (JP); Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 09/903,692

(22) Filed: Jul. 13, 2001

(65) Prior Publication Data

US 2002/0028101 A1 Mar. 7, 2002

(30) Foreign Application Priority Data

Jul. 13, 2000 (JP) ..... P2000-212757

(51) Int. Cl.[7] ..... B41J 32/00
(52) U.S. Cl. ..... 347/214; 400/207
(58) Field of Search ..... 347/214; 400/207, 400/208, 208.1

(56) References Cited

U.S. PATENT DOCUMENTS

| | | | | |
|---|---|---|---|---|
| 4,978,240 A | | 12/1990 | Katsuno | |
| 5,266,968 A | * | 11/1993 | Stephenson | 347/214 |
| 5,399,035 A | | 3/1995 | Nakae | |
| 5,415,486 A | * | 5/1995 | Wouters et al. | 400/207 |
| 5,455,617 A | * | 10/1995 | Stephenson et al. | 347/214 |
| 5,480,242 A | | 1/1996 | Gunderson | |
| 5,492,422 A | * | 2/1996 | Kondo | 400/208.1 |
| 5,547,298 A | * | 8/1996 | Wouters et al. | 400/207 |
| 5,600,361 A | * | 2/1997 | Dirx | 347/214 |
| 5,690,439 A | | 11/1997 | Sasaki et al. | |
| 5,695,292 A | * | 12/1997 | Coote | 400/208.1 |
| 5,865,545 A | * | 2/1999 | Kondo | 400/207 |

FOREIGN PATENT DOCUMENTS

| | | |
|---|---|---|
| EP | 0 358 520 | 12/1993 |
| EP | 0 931 672 A1 | 7/1999 |
| JP | 62-20845 | 7/1987 |
| JP | 2-74378 | 3/1990 |
| JP | 05270089 | 10/1993 |
| JP | 10006596 | 2/1998 |
| JP | 10315558 | 12/1998 |
| JP | 11058866 | 3/1999 |

* cited by examiner

*Primary Examiner*—Huan Tran
(74) *Attorney, Agent, or Firm*—Birch, Stewart, Kolasch & Birch, LLP

(57) ABSTRACT

An ink cassette includes a first part and a second part each of which has a first end provided with a substantially U-shaped bobbin holder and a second end provided with a similar bobbin holder. Each of the U-shaped bobbin holders has a pair of flexible arms defining a groove in which a pair of protrusions are provided. An ink ribbon set including an ink ribbon and two bobbins is stored in an ink ribbon supply container. The bobbins are supported at the same depth and spaced from each other a distance equal to a spacing between thee first and second parts. The ink cassette is overlaid on the ink ribbon set, with alignment marks aligned, and then the ink cassette is forced into the supply container. The bobbins are inserted past the protrusions into the grooves and are held around their axes by the arms.

5 Claims, 15 Drawing Sheets

INK CASSETTE, INK RIBBON CONTAINER, AND METHOD OF ATTACHING INK RIBBON TO INK CASSETTE

BACKGROUND OF THE INVENTION

1. Field of the Invention

The present invention relates to an ink cassette for holding an ink ribbon for use in a thermal transfer printer, a supply container for the ink ribbon, and a method of attaching the ink ribbon to the ink cassette. More particularly, the present invention relates to a technique for attaching an ink ribbon to an ink cassette easily and reliably, and a technique for reducing the running costs of a printer.

2. Description of the Background Art

FIGS. 14 and 15 are an external view and an exploded perspective view, respectively, of a conventional ink ribbon cartridge (also referred to simply as a "cartridge") 59P for use in a thermal transfer printer. The cartridge 59P is disclosed in, for example, Japanese Patent Application Laid-Open No. 2-74378 (1990).

An ink ribbon 3P stored in the cartridge 59P is wound around a supply bobbin 1P for a predetermined length from a first end thereof, and is fixed at its second end to a take-up bobbin 2P with a double-faced tape or the like. The ends of the bobbins 1P and 2P are placed on bobbin supports 55P, 56P, 57P and 58P, respectively, of a cartridge body 51P. A cartridge cover 52P is placed to cover the bobbins 1P and 2P. The cartridge body 51P and the cartridge cover 52P are bonded at their outer peripheral parts by ultrasonic welding or the like and fixed to each other. In the cartridge 59P, the ink ribbon 3P is exposed or uncovered from a window of the cartridge 59P formed by an opening 53P of the cartridge body 51P and an opening 54P of the cartridge cover 52P. The ink ribbon 3P, while being stored in the cartridge 59P, is mounted in a printer.

FIG. 16 is a schematic view for illustrating a method of printing using an ink ribbon in a thermal transfer printer. In the printer, a printing medium 62P in sheet form and the ink ribbon 3P exposed from the window are overlaid on a platen 61P, as shown in FIG. 16. A thermal head 60P having a plurality of small heat generators (not shown) applies pressure and heat to transfer a dye from the ink ribbon 3P to the printing medium 62P in sheet form. This produces an image on the printing medium 62P in sheet form.

A direct touch of a user's hand on the ink ribbon 3P causes sebum on the user's hand to adhere to the ink ribbon 3P, giving rise to transfer imperfection. A wrinkle in the ink ribbon 3P also results in transfer imperfection. However, the cartridge 59P allows the mounting of the ink ribbon 3P in the printer without the direct touch of foreign matter on the ink ribbon 3P.

More specifically, the position of the supply bobbin 1P supported by the bobbin supports 55P and 56P is designed so that the ink ribbon 3P prior to use which is wound around the supply bobbin 1P is floating in the air inside the cartridge 59P. Likewise, the ink ribbon 3P after use is also held floating inside the cartridge 59P.

The conventional ink ribbon cartridge 59P in which the cartridge body 51P and the cartridge cover 52P are bonded and fixed to each other as described above is difficult to disassemble. For replacement and discard of the ink ribbon 3P after use, the whole cartridge 59P with the ink ribbon 3P stored therein is required to be replaced and is discarded. Further, because of the difficulty in disassembling, it is impossible to reuse the cartridge body 51P and the cartridge cover 52P. The result of these disadvantages is the increased price of the conventional cartridge 59P.

Furthermore, the conventional ink ribbon 3P is not only enclosed by the cartridge body 51P and the cartridge cover 52P but also is contained in a plastic case or a corrugated cardboard carton during distribution. Thus, the materials enclosing the ink ribbon 3P accordingly increase the cost and price of the cartridge 59P.

The use of the conventional cartridge 59P thus presents the problem of increased running costs of the printer.

SUMMARY OF THE INVENTION

A first aspect of the present invention is intended for an ink cassette for holding an ink ribbon set, the ink ribbon set having a pair of bobbins each including a rod-shaped body, and an ink ribbon having a first end fixed to one of the bobbins and a second end, the ink ribbon, including the second end, being wound around the other of the bobbins. According to the present invention, the ink cassette comprises: a first part and a second part arranged in parallel with each other, each of the first and second parts including an elongate portion having bobbin holders for holding a corresponding one of the bobbins at respective longitudinal end portions in a longitudinal direction thereof, wherein each of the bobbin holders includes a pair of arms, the pair of arms defining a linear groove (or notch) extending in a direction intersecting the longitudinal direction, and wherein all of the grooves are placed in the same orientation, whereby each of the bobbins is received in a corresponding pair of the grooves and held around its axis.

Preferably, according to a second aspect of the present invention, in the ink cassette of the first aspect, each of the arms is flexible, and each of the grooves includes a portion having a width less than a diameter of a shaft of each of the bobbins.

Preferably, according to a third aspect of the present invention, in the ink cassette of the first or second aspect, there is a difference in width between at least one pair of the grooves included among two pairs of the grooves arranged in a direction in which the first and second parts are arranged, and there is a difference in width between a pair of the grooves possessed by each of the first and second parts.

Preferably, according to a fourth aspect of the present invention, in the ink cassette of any one of the first to third aspects, the first part has an alignment mark affixed to an opposite side from an opening of the grooves.

A fifth aspect of the present invention is intended for an ink ribbon supply container for storing an ink ribbon set therein, the ink ribbon set having a pair of bobbins each including a rod-shaped body, and an ink ribbon having a first end fixed to one of the bobbins and a second end, the ink ribbon, including the second end, being wound around the other of the bobbins. According to the present invention, the ink ribbon supply container comprises: a container body recessed in shape and sized to allow the ink cassette as recited in any one of the first to fourth aspects to enter the recessed container body, with the ink cassette assuming a position such that a plane defined to include the elongate portions of the first and second parts is in face-to-face relationship with a bottom part of the recessed container body; and a first bobbin support and a second bobbin support both provided in the recessed container body for supporting the bobbins laid down in the recessed container body respectively and for supporting the bobbins in parallel with each other in a position of an approximately equal depth in the recessed container body.

Preferably, according to a sixth aspect of the present invention, in the ink ribbon supply container of the fifth aspect, a side portion of the recessed container body functions to guide the ink cassette so that the groove of each of the bobbin holders is in face-to-face relationship with a corresponding one of the bobbins supported by the first and second bobbin supports when the ink cassette assuming the position enters the container body.

A seventh aspect of the present invention is intended for a method of attaching an ink ribbon to an ink cassette. According to the present invention, the method comprises the steps of: (a) preparing the ink cassette as recited in any one of the first to fourth aspects; (b) preparing the ink ribbon set stored in the ink ribbon supply container as recited in the fifth or sixth aspect; (c) overlaying the ink cassette on the ink ribbon set, with the groove of each of the bobbin holders in face-to-face relationship with a corresponding one of the bobbins; and (d) applying pressure toward the ink ribbon set to the ink cassette to insert each of the bobbins into a corresponding pair of the grooves.

In accordance with the first aspect of the present invention, the ink ribbon (set) is easily attached to the ink cassette by inserting (forcing) the bobbins into the grooves of the bobbin holders in a direction from the opening end of the grooves to the bottom part thereof. Additionally, since all of the grooves are in the same orientation, the two bobbins are simultaneously inserted into the grooves only by placing the bobbins in face-to-face relationship with the corresponding grooves and then pressing the ink cassette inwardly in the opening direction of the grooves. A user can attach the ink ribbon (set) to the ink cassette without touching the ink ribbon.

Further, the ink cassette can be reused by removing the ink ribbon (set) after use from the ink cassette. That is, only the ink ribbon set is replaced. This reduces the running costs of a printer.

In accordance with the second aspect of the present invention, the bobbins inserted in the grooves are prevented from disengaging from the grooves. The arms which are flexible are distorted and widened, and thus do not hinder the insertion of the bobbins.

In accordance with the third aspect of the present invention, the ink cassette is prevented from being mounted in an improper orientation.

In accordance with the fourth aspect of the present invention, the user can find the mounting orientation of the ink cassette by the alignment marks. This prevents the ink cassette from being mounted in an improper orientation. Additionally, the alignment marks affixed to the opposite side from the opening of the grooves facilitate and ensure the attachment process.

In accordance with the fifth aspect of the present invention, the ink ribbon (set) is easily attached to the ink cassette by overlaying the ink cassette on the ink ribbon set stored in the ink ribbon supply container and forcing the ink cassette toward the ink ribbon. Additionally, the bobbin supports support the ink ribbon (set) in a predetermined position, thereby eliminating the need for the user to take the ink ribbon (set) out of the ink ribbon supply container and to grasp the ink ribbon (set). In other words, the user can perform the attachment process without touching the ink ribbon.

Unlike a conventional ink ribbon cartridge in which an ink ribbon set and an ink cassette are integrated together, the supply container according to the fifth aspect of the present invention allows the supply of only the ink ribbon set, to reduce materials and the like enclosing the ink ribbon during distribution or supply, thereby making the ink ribbon available at low prices. Therefore, costs and prices are reduced, and consequently the running costs of the printer is reduced.

In accordance with the sixth aspect of the present invention, a face-to-face relationship is easily and reliably established between the grooves of the respective bobbin holders and the bobbins stored in the ink ribbon supply container.

In accordance with the seventh aspect of the present invention, the ink ribbon (set) is easily attached to the ink cassette. Additionally, the user need not take the ink ribbon (set) out of the ink ribbon supply container and to grasp the ink ribbon (set). Therefore, the user can perform the attachment process without touching the ink ribbon.

It is therefore a primary object of the present invention to provide an ink cassette and an ink ribbon supply container which are capable of attaching an ink ribbon thereto easily and reliably, and of reducing the running costs of a printer.

It is another object of the present invention to provide a method of attaching an ink ribbon to an ink cassette by the use of the ink cassette and the ink ribbon supply container which attain the primary object.

These and other objects, features, aspects and advantages of the present invention will become more apparent from the following detailed description of the present invention when taken in conjunction with the accompanying drawings.

DESCRIPTION OF THE PREFERRED EMBODIMENTS

<First Preferred Embodiment>

A. Construction of Ink Ribbon Set

Figure 1:
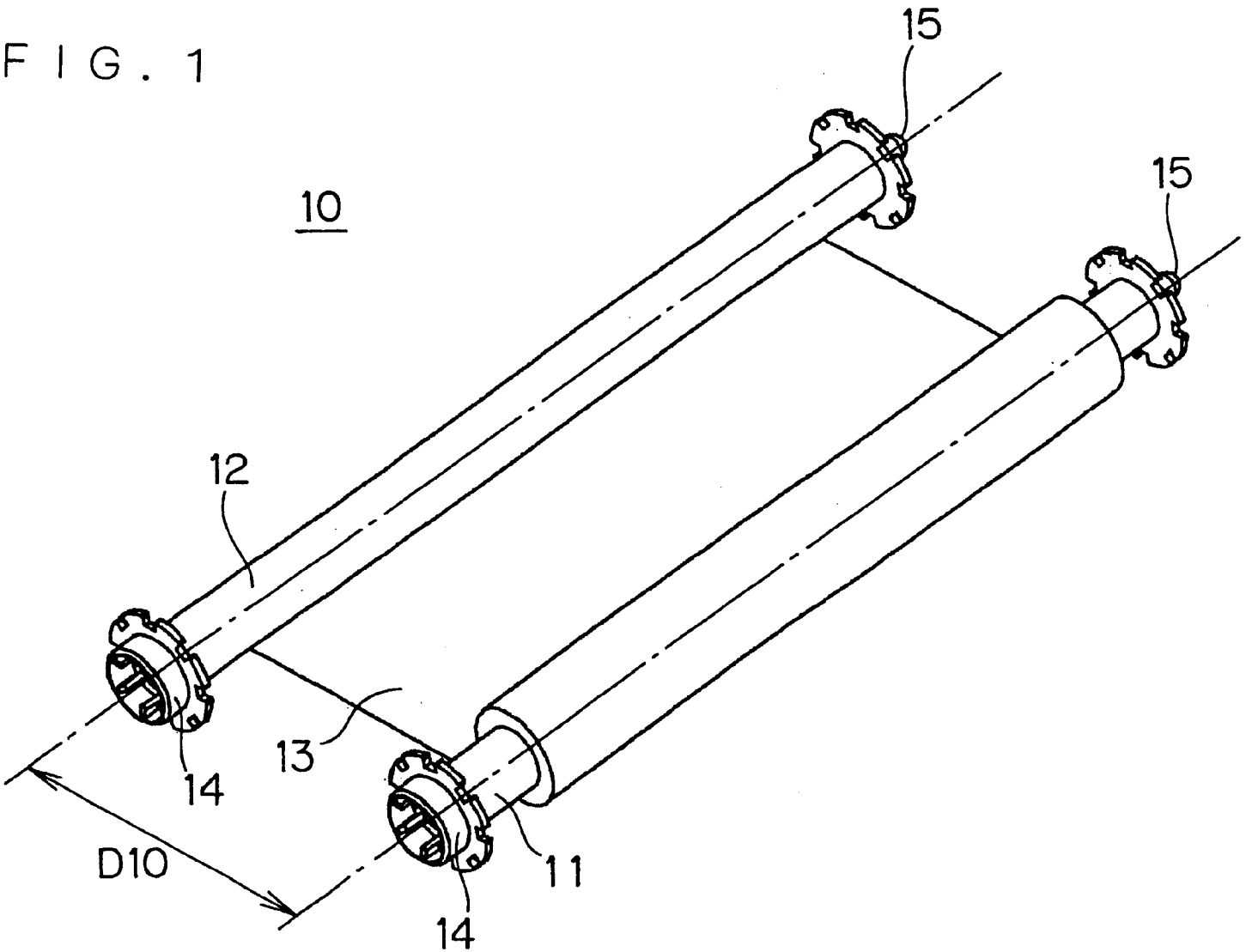
FIG. 1 is an external view of an ink ribbon set according to a first preferred embodiment of the present invention.

FIG. 1 is an external view of an ink ribbon roll or ink ribbon set 10 according to a first preferred embodiment of the present invention. As shown in FIG. 1, the ink ribbon set 10 comprises an ink ribbon 13, a supply bobbin 11 and a take-up bobbin 12. The supply bobbin and the take-up bobbin are also referred to simply as "bobbins" hereinafter.

The ink ribbon 13 includes a film of a continuous length and of a predetermined width which is coated with a dye or pigment. For example, an ink ribbon for color printing is coated with a succession of dyes of respective colors: cyan, magenta and yellow.

The supply bobbin 11 includes a rod-shaped body of a length greater than the width of the ink ribbon 13. The ink ribbon 13 is wound around a mid-portion of the supply bobbin 11. The rod-shaped body has a first end portion 14 formed into a shape connectable with a driver of a printer, and a second end portion 15 narrower than the mid-portion thereof.

The take-up bobbin 12 is similar in shape to the supply bobbin 11. Specifically, the take-up bobbin 12 includes a rod-shaped body having first and second end portions 14 and 15 similar to those of the supply bobbin 11.

When not yet in use, a first end of the ink ribbon 13 is fixed to the take-up bobbin 12 with a double-faced tape or the like, and substantially the whole of the ink ribbon 13 including a second end thereof is wound around the supply bobbin 11. At this time, the end portions 14 of the respective bobbins 11 and 12 of the ink ribbon set 10 are directed in the same orientation, and the end portions 15 thereof are also directed in the same orientation.

The ink ribbon set 10 is set in the printer, with the bobbins 11 and 12 in parallel with each other and spaced a predetermined distance apart from each other. During printing, as the driver of the printer rotates the take-up bobbin 12 about its axis, the ink ribbon 13 is wound on the take-up bobbin 12. In particular, the ink ribbon set 10 or the ink ribbon 13 is held by an ink cassette 40 to be described below for mounting in the printer.

B. Construction of Ink Cassette

Figure 2:
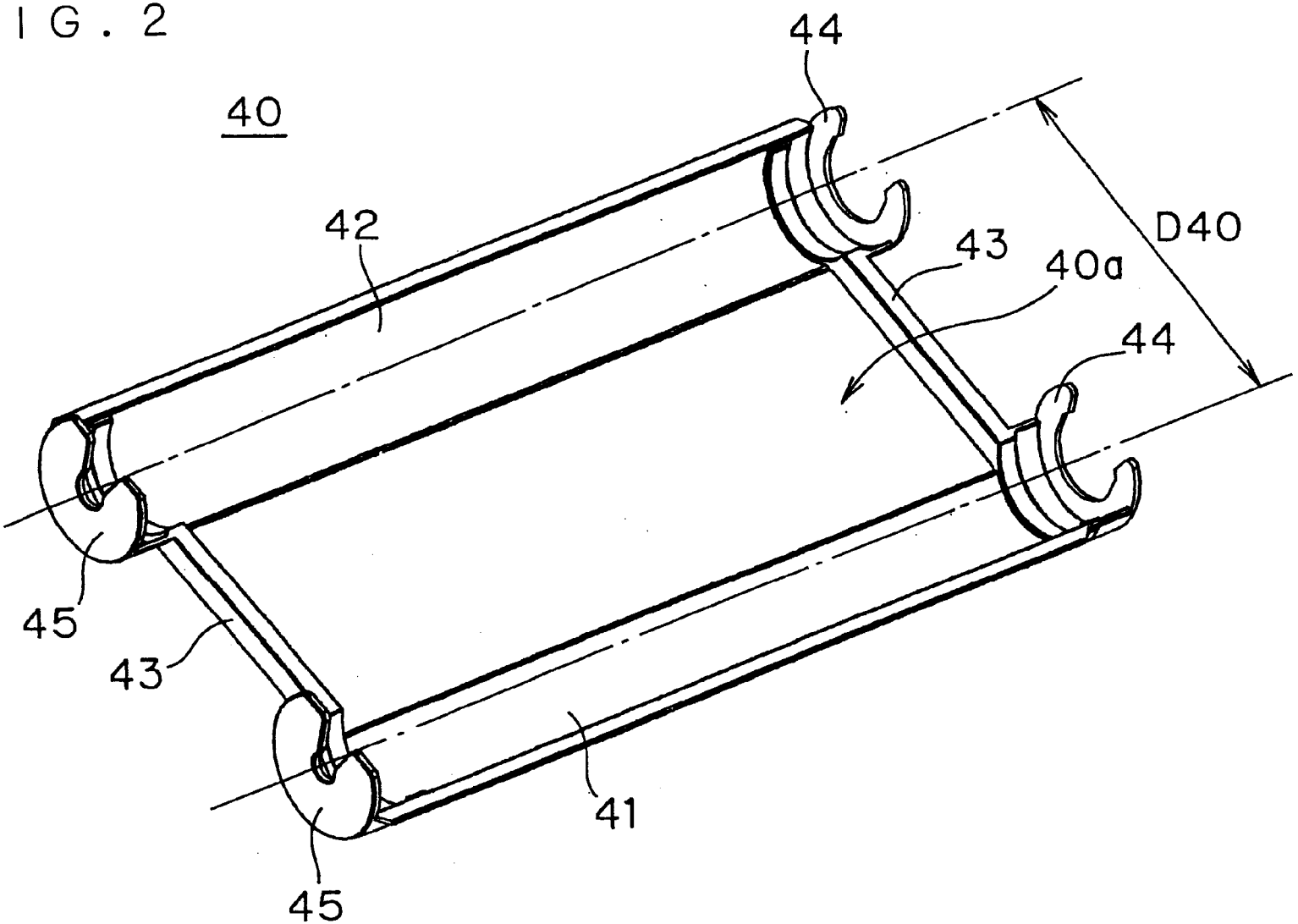
FIGS. 2 and 3 are external views of an ink cassette according to the first preferred embodiment.
Figure 3:
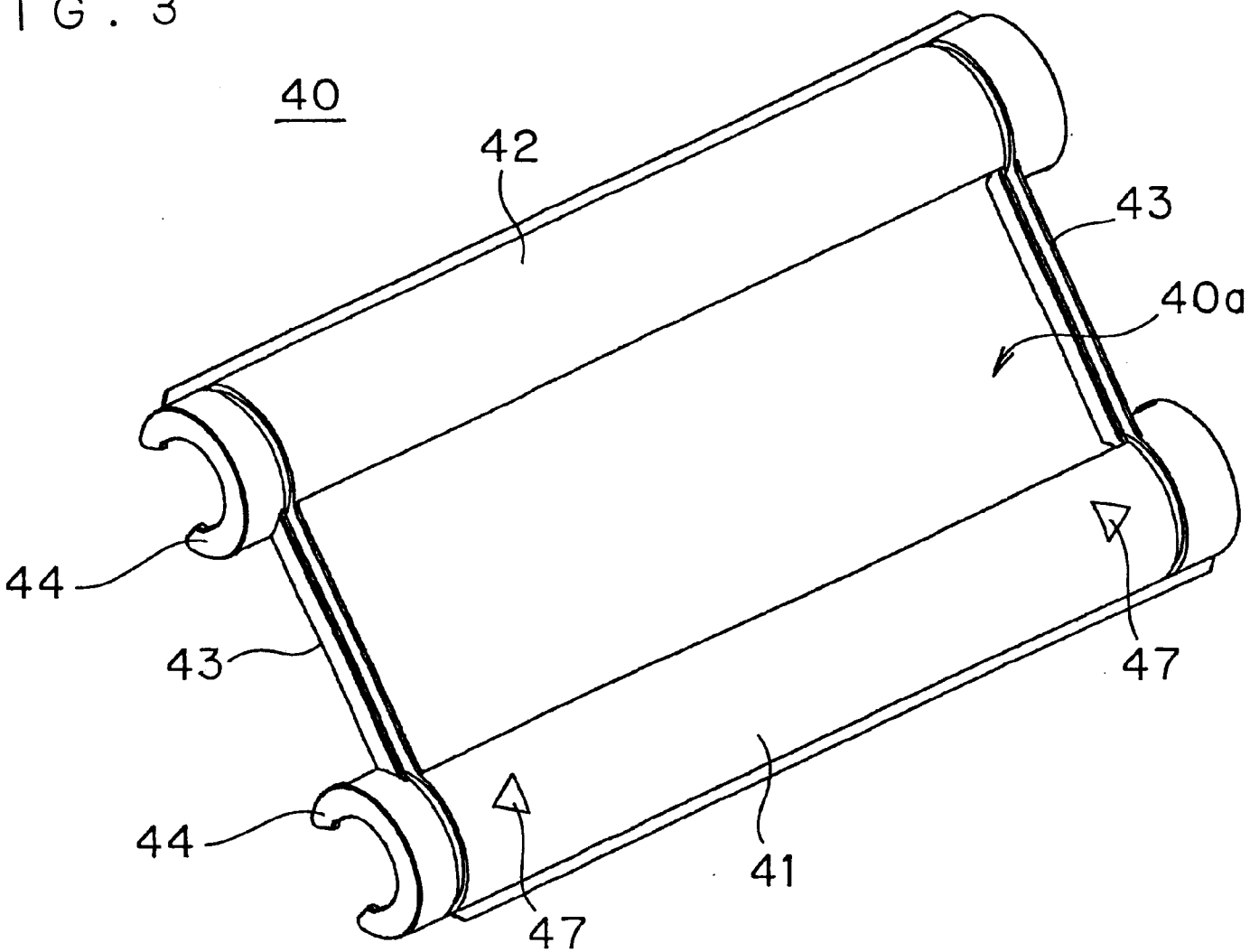
Figure 4:
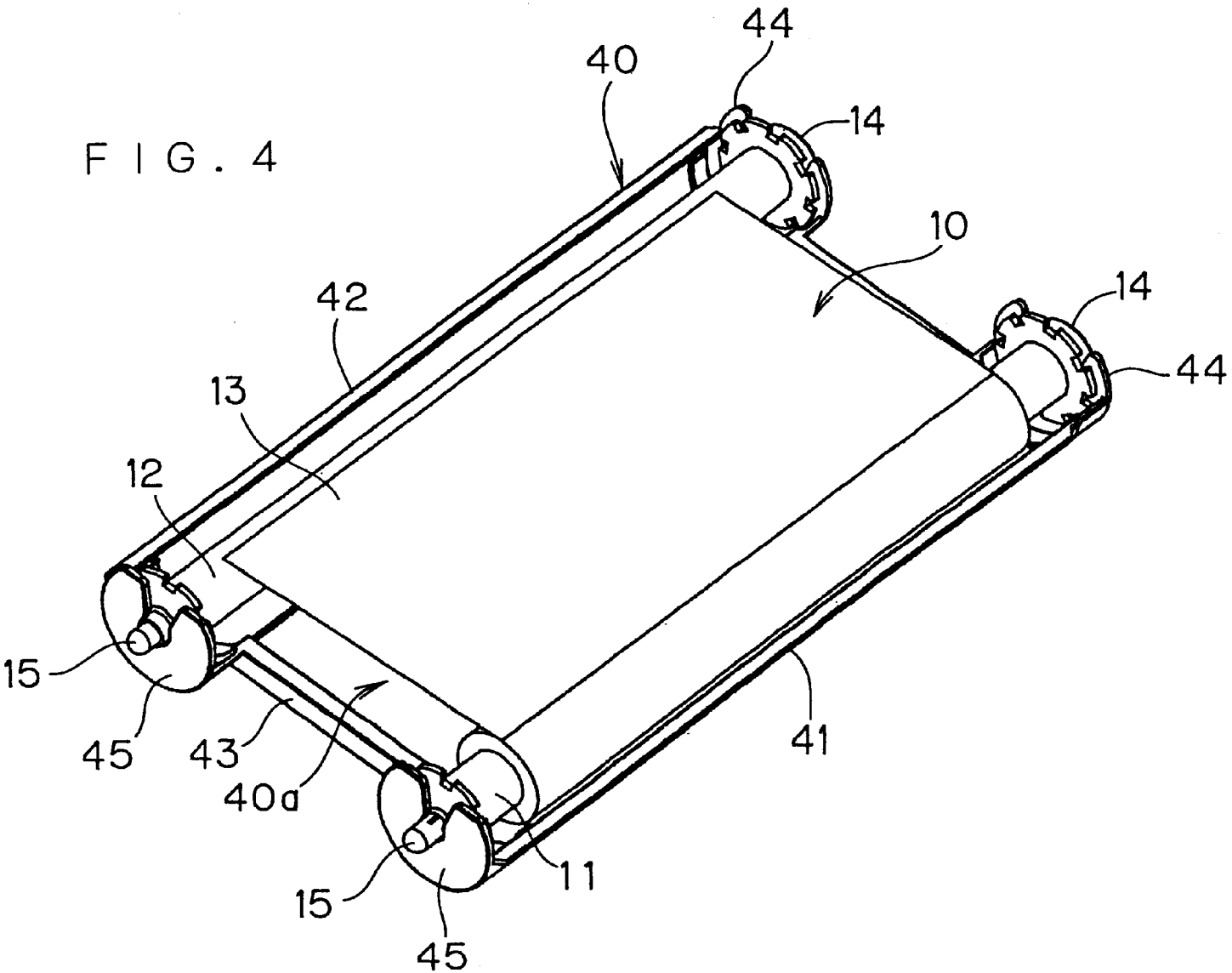
FIG. 4 is a view for illustrating the ink ribbon set attached to the ink cassette.
Figure 5:
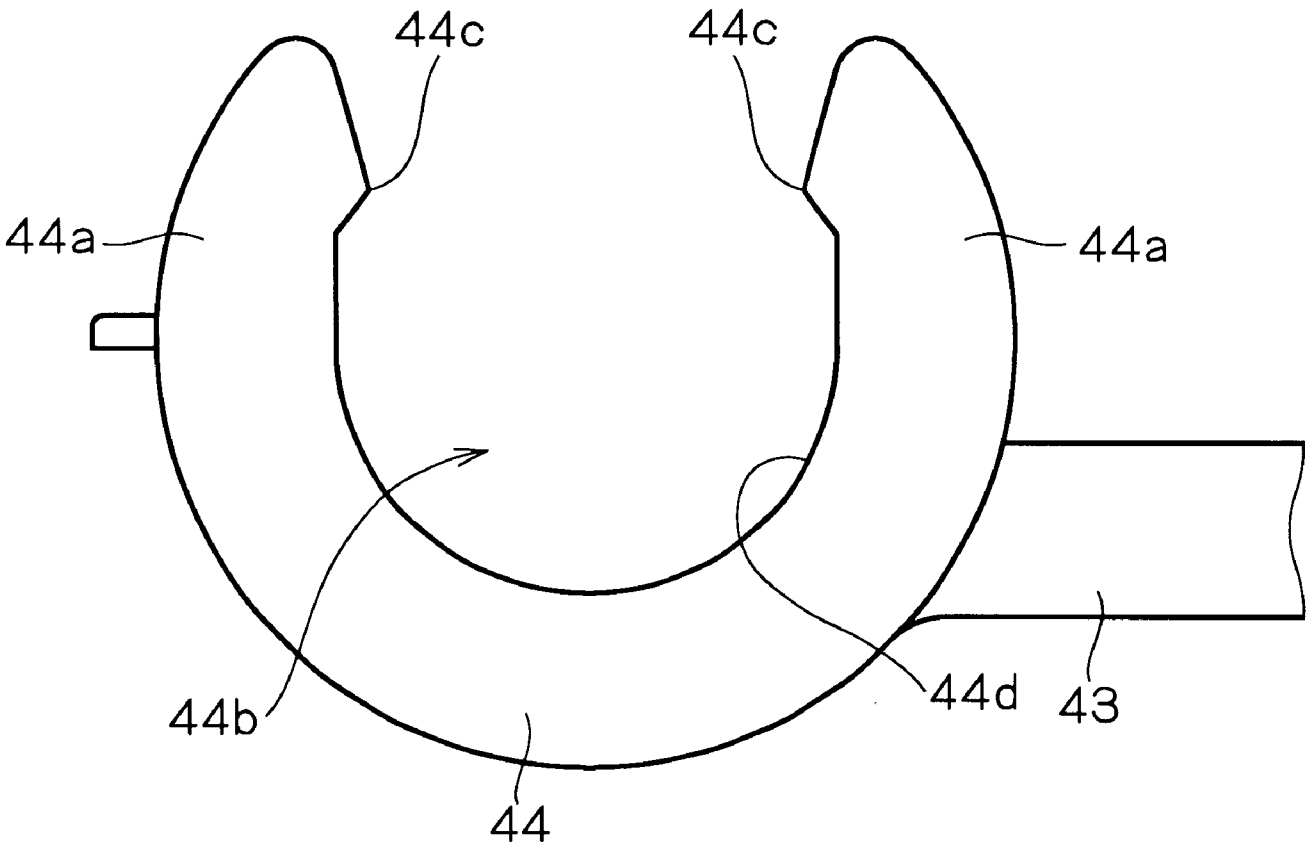
FIG. 5 is an enlarged view of a bobbin holder in the ink cassette according to the first preferred embodiment.
Figure 6:
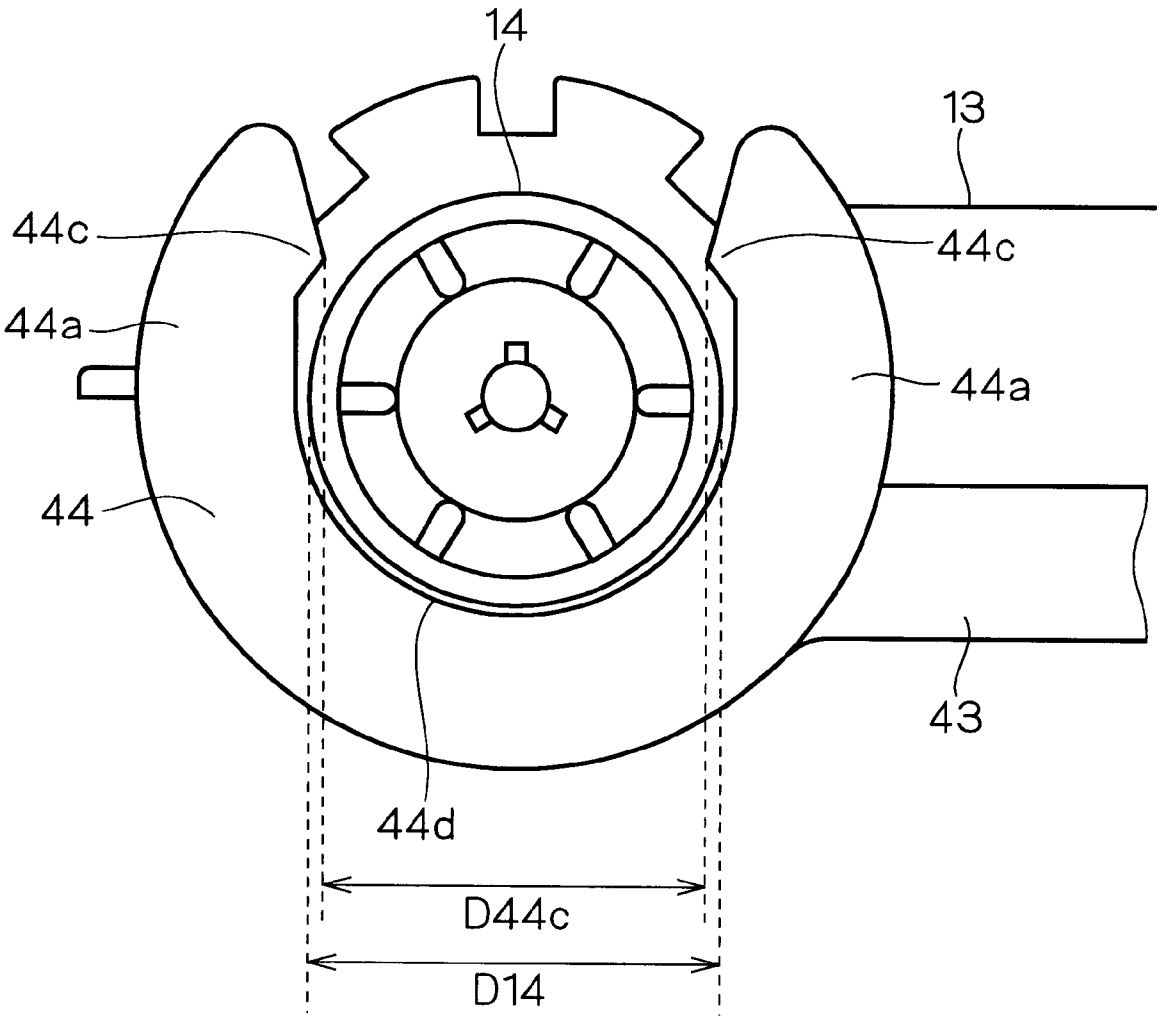
FIG. 6 is a view for illustrating a bobbin inserted in the bobbin holder according to the first preferred embodiment.
Figure 7:
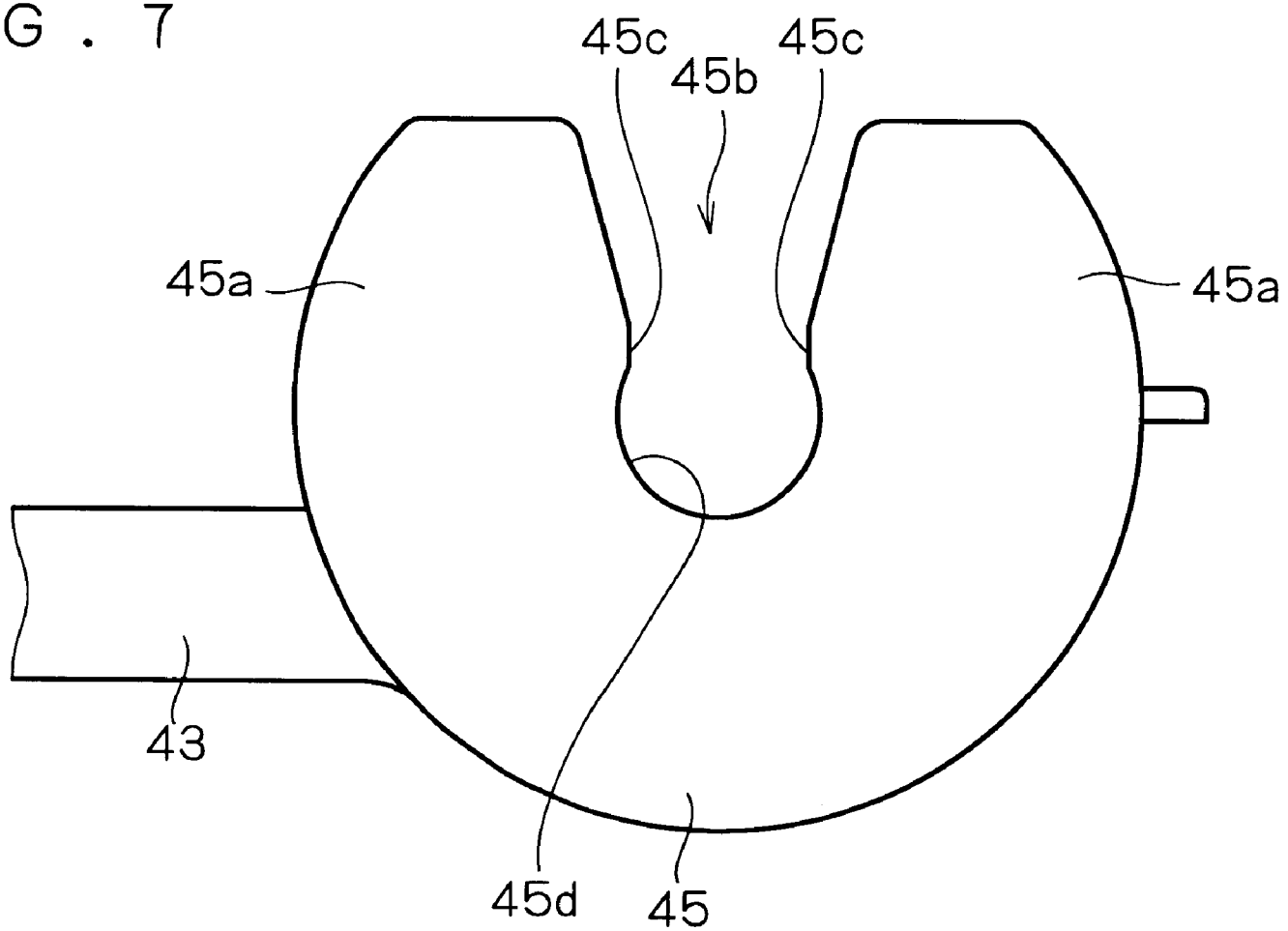
FIG. 7 is an enlarged view of another bobbin holder in the ink cassette according to the first preferred embodiment.
Figure 8:
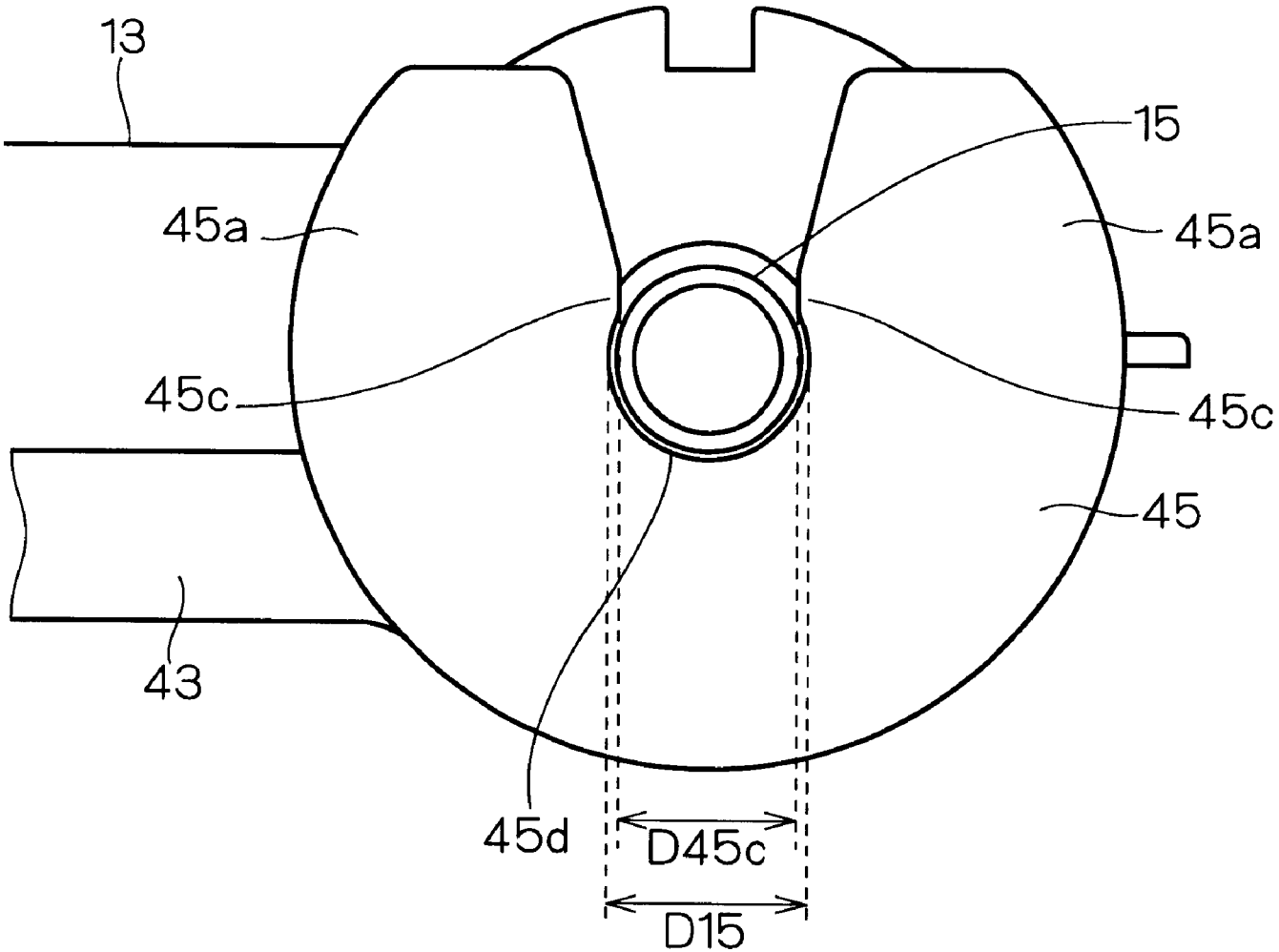
FIG. 8 is a view for illustrating the bobbin inserted in the bobbin holder of FIG. 7 according to the first preferred embodiment.

FIGS. 2 and 3 are external views of the ink cassette 40 according to the first preferred embodiment. FIG. 4 is a view for illustrating the ink ribbon set 10 attached to the ink cassette 40. FIGS. 5 and 7 are enlarged views of bobbin holders 44 and 45, respectively, of the ink cassette 40. FIGS. 6 and 8 are views for illustrating the bobbins 11 and 12 held in the bobbin holders 44 and 45, respectively.

The ink cassette 40 comprises a frame-shaped body including a first part 41, a second part 42 and a pair of third parts 43. The first, second and third parts 41, 42, 43 define a quadrangular opening or window 40*a* of the frame-shaped body. The bobbin holder 44 or 45 having a groove (or a notch) 44*b* or 45*b* is provided at each of the four corners of the frame-shaped body. The end portions 14 and 15 of the bobbins 11 and 12 are inserted into the respective grooves 44*b* and 45*b*, whereby the ink ribbon set 10 is set in the ink cassette 40 (see FIGS. 4, 6 and 8). The ink cassette 40 is made of, for example, resin.

More specifically, each of the first and second parts 41 and 42 comprises an elongate portion having, for example, a semicircular cross-sectional shape and approximately equal in length to the bobbins 11 and 12. The bobbin holders 44 and 45 are provided upright in the same orientation on the longitudinal ends of the elongate portion.

The bobbin holder 44 is substantially U-shaped, and a pair of arms 44*a* of the substantially U-shaped bobbin holder 44 define the linear groove 44*b*. The groove 44*b* extends in a direction intersecting (herein perpendicular to) the longitudinal direction of the elongate portion. Each of the bobbins 11 and 12 is held rotatably about its axis in the bobbin holder 44, with the end portion thereof 14 inserted in the groove 44*b* (see FIG. 6).

A pair of protrusions 44*c* are provided at some midpoint between the opening end and the bottom in the groove 44*b*. A distance D44*c* between the pair of protrusions 44*c* in the groove 44*b* is less than the diameter D14 of the shaft of the end portion 14 of each of the bobbins 11 and 12. A portion 44*d* of the groove 44*b* which extends from the protrusions 44*c* to the bottom is shaped to surround the end portion 14 of each of the bobbins 11 and 12 about its axis and to hold the end portion 14 rotatably about the axis of each of the bobbins 11 and 12. In other words, the portion 44*d* functions as a bearing of the end portion 14 of each of the bobbins 11 and 12. For this reason, the portion 44*d* is also referred to as a "bearing portion 44*d*" hereinafter. A pair of portions of the groove 44*b* which extend from the opening end to the protrusions 44*c* have a spacing therebetween greater than the diameter D14 of the end portion 14.

In particular, the pair of arms 44*a* are flexible. Since the ink cassette 40 and, thus, the arms 44*a* are made of resin, a flexible property may be imparted to the arms 44*a*, for example, depending on the settings of the width, thickness and length of the arms 44*a* or the like.

As illustrated in FIGS. 7 and 8, the bobbin holder 45 is substantially similar in shape to the above-mentioned bobbin holder 44. More specifically, the groove 45*b* defined by a pair of arms 45*a* of the substantially U-shaped bobbin holder 45 extends in a direction intersecting (herein perpendicular to) the longitudinal direction of the above-mentioned elongate portion. Each of the bobbins 11 and 12 is held rotatably about its axis in the bobbin holder 45, with the end portion thereof 15 inserted in the groove 45*b* (see FIG. 8). The pair of arms 45*a* are flexible.

A pair of protrusions 45*c* similar to the above-mentioned protrusions 44*c* are provided in the groove 45*b*. A distance D45*c* between the pair of protrusions 45*c* in the groove 45*b* is less than the diameter D15 of the shaft of the end portion 15 of each of the bobbins 11 and 12. A bearing portion 45*d* of the groove 45*b* which extends from the protrusions 45*c* to the bottom surrounds the end portion 15 of each of the bobbins 11 and 12 about its axis and holds each of the bobbins 11 and 12 rotatably about its axis. A pair of portions of the groove 45*b* which extend from the opening end to the protrusions 45*c* have a spacing therebetween greater than the diameter D15 of the end portion 15.

In particular, all of the grooves 44*b* and 45*b* extend (or are open) in the same direction in the ink cassette 40.

The widths of the respective grooves 44*b* and 45*b* or the distances between the respective pairs of arms 44*a* and 45*a* differ from each other because of the difference between the diameters D14 and D15 of the shafts of the respective end portions 14 and 15. The same is true for the first and second parts 41 and 42. The orientation of the substantial U-shape of each of the bobbin holders 44 and 45 and the positions of the respective bearing portions 44*d* and 45*d* are established so that the bobbin 11 is held in parallel with the first part 41 and so that the bobbin 12 is held in parallel with the second part 42. The positions of the respective bearing portions 44*d* and 45*d* are established so that the bobbins 11, 12 and the ink ribbon 13 do not contact the elongate portions of the first and second parts 41 and 42.

In the ink cassette 40, the first and second parts 41 and 42 are in parallel with each other. The bobbin holders 44 are arranged in line and the bobbin holders 45 are arranged in line, as viewed in a direction in which the first and second parts 41 and 42 are arranged. The first and second parts 41 and 42 are connected with the pair of third parts 43 therebetween to constitute the above-mentioned frame-shaped body and to define the window 40*a* of the frame-shaped body. The pair of third parts 43 are spaced a distance greater than the width of the ink ribbon 13 apart from each other.

A distance or spacing D40 between the two grooves 44*b* and between the two grooves 45*b* arranged in the direction in which the first and second parts 41 and 42 are arranged corresponds to a distance D10 (see FIG. 1) between the axes of (the rod-shaped bodies of) the bobbins 11 and 12, with the ink ribbon set 10 attached to the ink cassette 40. The distance D40 is also referred to as a "spacing D40 between the first and second parts 41 and 42" hereinafter.

As shown in FIG. 3, alignment marks 47 (also referred to simply as "marks 47" hereinafter) of, e.g., a triangular shape are affixed to the first part 41 of the ink cassette 40 near the respective end portions thereof. In particular, the alignment marks 47 are affixed to the opposite surface of the first part 41 from the surface on which the bobbin holders 44 and 45 are provided upright. The marks 47 and the grooves 44*b*, 45*b* are present on the opposite sides of the elongate portion of the first part 41. The marks 47 are provided by, for example, embossing, printing or affixation of stickers.

C. Construction of Ink Ribbon Supply Container

Figure 9:
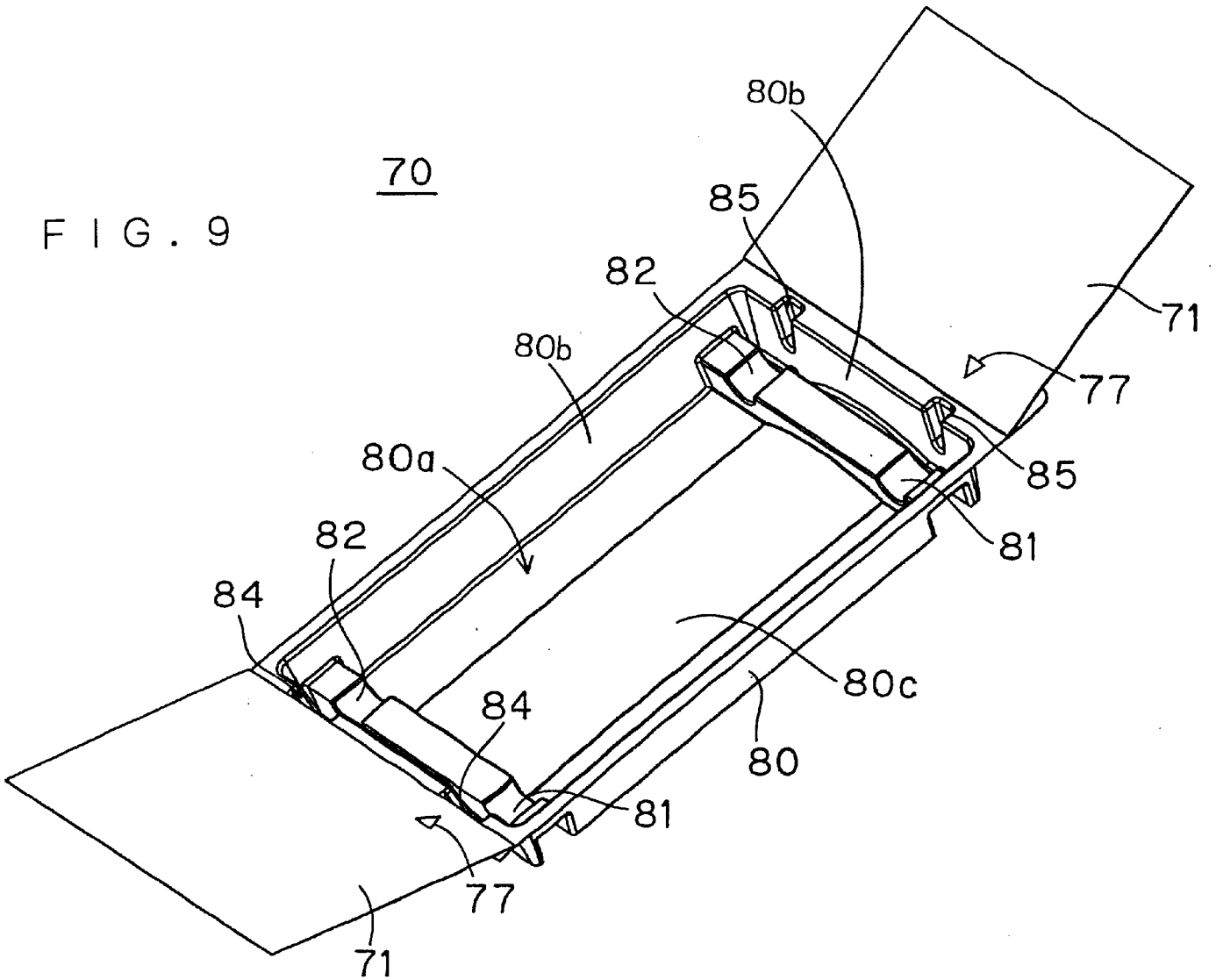
FIG. 9 is an external view of an ink ribbon supply container according to the first preferred embodiment.
Figure 10:
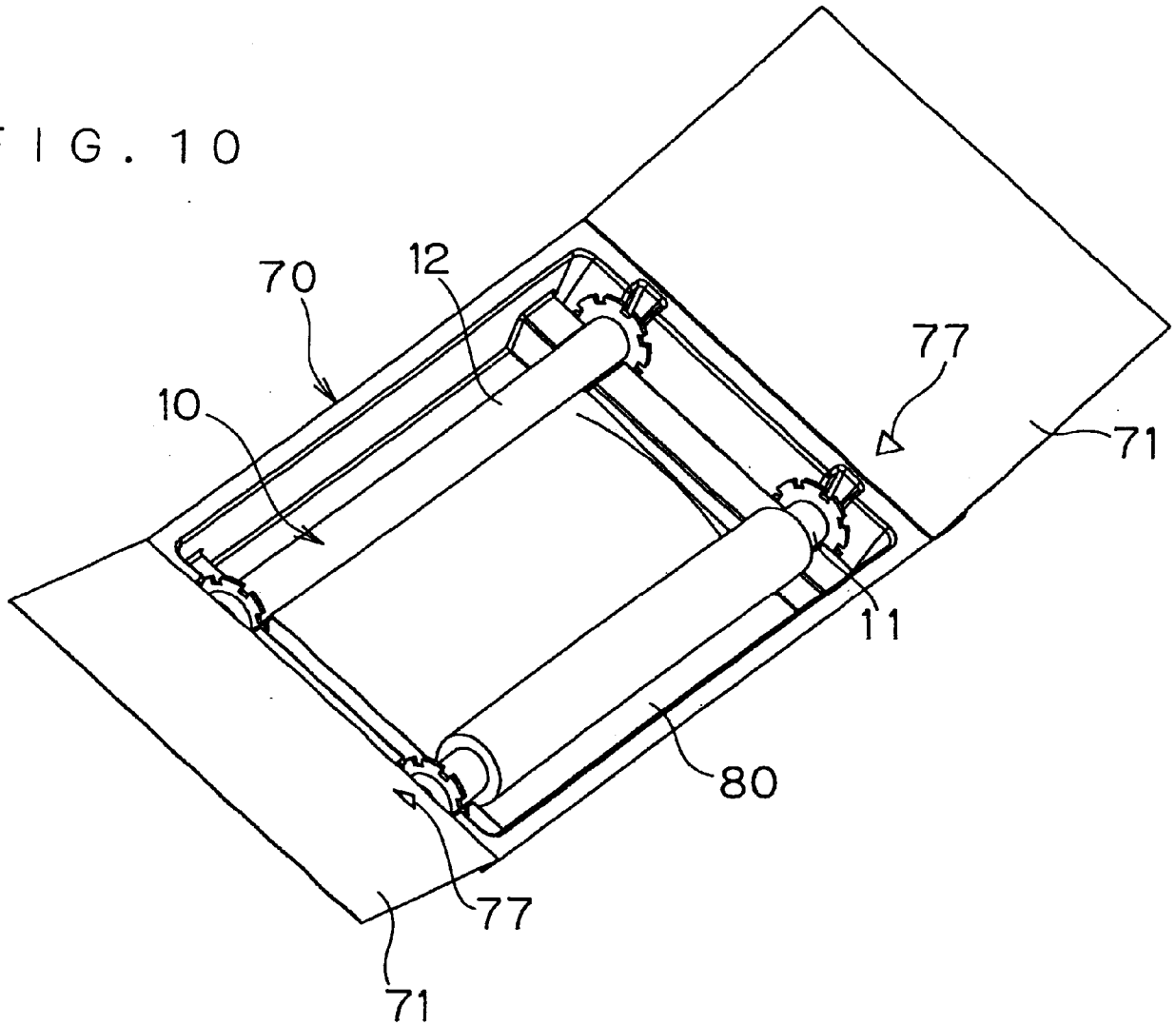
FIG. 10 is a view for illustrating the ink ribbon set stored in the ink ribbon supply container.
Figure 11:
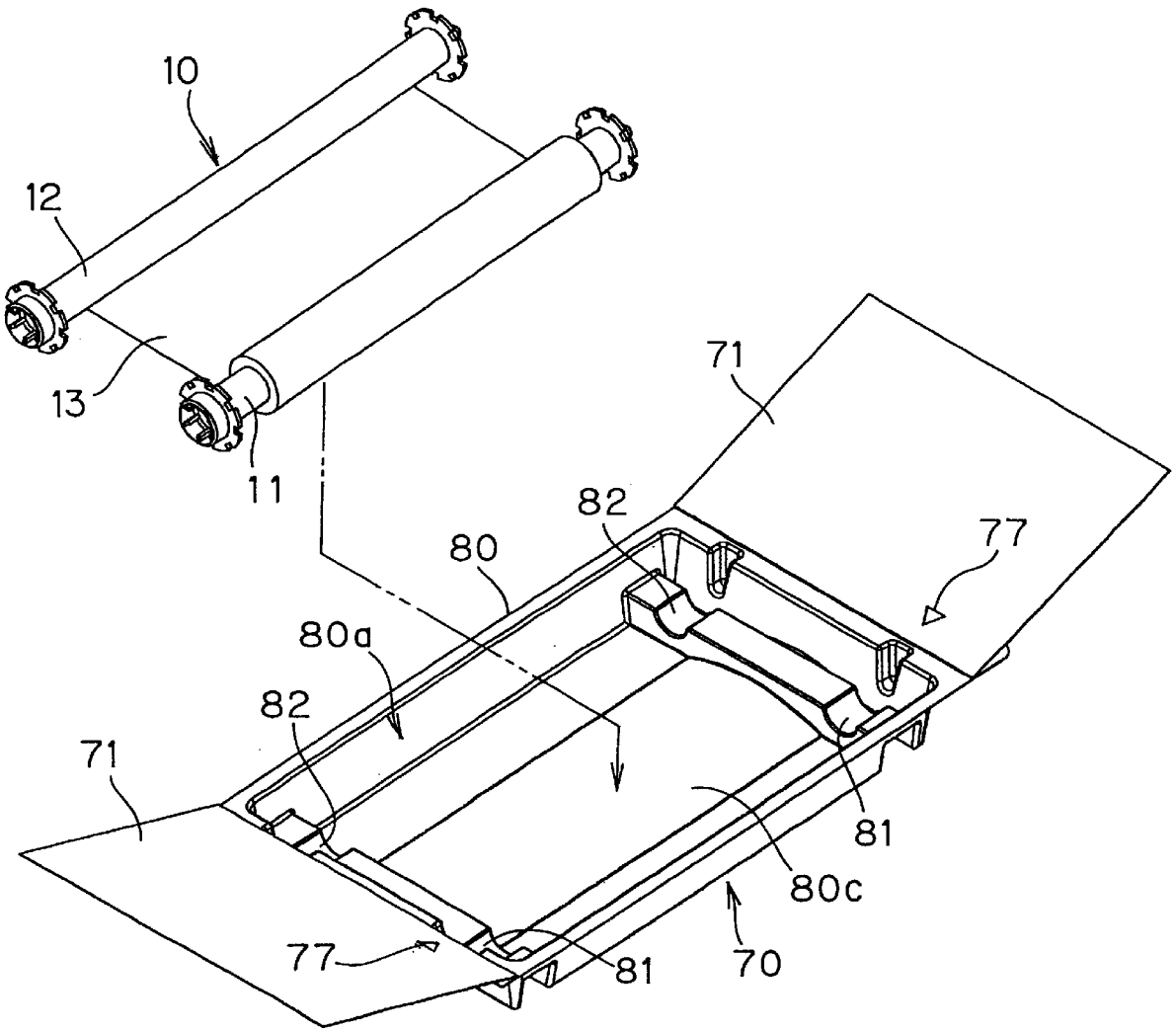
FIG. 11 is a view for illustrating the ink ribbon set to be stored in the ink ribbon supply container.

FIG. 9 is an external view of an ink ribbon supply container (also referred to simply as a "supply container" hereinafter) 70 according to the first preferred embodiment. FIG. 10 is a view for illustrating the ink ribbon set 10 stored in the supply container 70. FIG. 11 is a view for illustrating the ink ribbon set 10 to be stored in the supply container 70.

The supply container 70 is roughly divided into a recessed container body 80 and a cover 71. Although the cover 71 is shown in FIG. 9 and other figures as separated in the middle into two and opened, the cover 71 closes an opening of the recessed container body 80 to define an enclosed space 80*a* in the (recessed) container body 80 during distribution.

The space 80*a* in the container body 80 is sized to receive the whole of the ink ribbon set 10. The ink ribbon set 10 is stored in the container body 80, with the bobbins 11 and 12 laid down in parallel with each other and with the ink ribbon 13 in face-to-face relationship with a bottom part 80*c* of the container body 80 (see FIGS. 10 and 11). In particular, the space 80*a* in the container body 80 is shaped and sized to allow the ink cassette 40 to enter the space 80*a*, with the ink cassette 40 assuming such a position that the window 40*a* of the ink cassette 40, i.e., a plane defined to include the first and second parts 41 and 42 is in face-to-face relationship with the bottom part 80*c* of the container body 80 (see FIGS. 12 and 13 to be discussed later).

Side parts 80*b* of the container body 80 are shaped and sized to guide the ink cassette 40 when the ink cassette 40 in the above-mentioned position enters the container body 80. More specifically, the side parts 80*b* guide the ink cassette 40 so that the grooves 44*b* and 45*b* of the bobbin holders 44 and 45 are in face-to-face relationship with the end portions 14 and 15 of the bobbins 11 and 12 stored in the container body 80. Such a guide function is attained, for example, by inclining the side parts 80*b* so that the opening becomes smaller in a direction from the opening end to the bottom part 80*c*.

A pair of bobbin supports (also referred to generically as a first bobbin support) 81 for supporting the supply bobbin 11 in a predetermined position are provided in the container body 80. More specifically, each of the bobbin supports 81 is shaped and sized to receive the bobbin 11 thereon or therein so as to surround (part of) the bobbin 11 around its axis, for example, recess- or groove-shaped. Although the bobbin supports 81 and bobbin supports 82 to be described later are shown in FIG. 9 and other figures as having an arcuate groove-like (vertical) sectional shape, the sectional shape of the supports 81 and 82 may be a quadrangle, a triangle or the like. The pair of bobbin supports 81 are disposed near the end portions 14 and 15, respectively, of the supply bobbin 11 laid down in the container body 80, more particularly in a position where the bobbin supports 81 do not contact the ink ribbon 13.

Another pair of bobbin supports (also referred to generically as a second bobbin support) 82 similar in configuration to the bobbin supports 81 and for supporting the take-up bobbin 12 in a predetermined position are provided in the container body 80. The pair of bobbin supports 82 are disposed near the end portions 14 and 15, respectively, of the take-up bobbin 12 laid down in the container body 80, more particularly in a position where the bobbin supports 82 do not contact the ink ribbon 13.

In particular, the bobbin supports 81 and 82 are formed to support the bobbins 11 and 12 in parallel with each other in a position of an approximately equal depth in the container body 80. Additionally, the pairs of bobbin supports 81 and 82 are provided so that the distance D10 (see FIG. 1) between the axes of (the rod-shaped bodies of) the bobbins 11 and 12 as stored in the container body 80 is equal to the spacing D40 (see FIG. 2) between the first and second parts 41 and 42.

The side parts 80*b* of the container body 80 are formed with guide slots 84 and 85 for receiving the end portions 14 and 15, respectively, of the bobbins 11 and 12 to guide the bobbins 11 and 12 to the bobbin supports 81 and 82 when the bobbins 11 and 12 are stored in the container body 80.

The container body 80 having the above-mentioned shaped may be formed by vacuum forming or pressure forming of synthetic resin. Alternatively, the container body 80 may be formed of corrugated cardboard or the like.

The cover 71 is made of a sheet of paper, plastic film or the like. During distribution, for example, the cover 71 closes the opening of the container body 80 with the ink ribbon set 10 stored therein and is bonded or welded to the container body 80. This provides the enclosed space 80*a* in the container body 80, and, after the enclosure, prevents the ink ribbon 13 from being contacted by dust, a hand and a finger.

Alignment marks 77 (also referred to simply as "marks 77" hereinafter) of, e.g., a triangular shape are affixed to a surface of the cover 71 on the space 80*a* side (referred to hereinafter as an "inner surface of the cover 71 "). More specifically, the alignment marks 77 are positioned in substantially face-to-face relationship with the end portions 14 and 15 of the supply bobbin 11 in the above-mentioned enclosed condition. The marks 77 are provided by, for example, embossing, printing or affixation of stickers.

D. Method of Attaching Ink Ribbon to Ink Cassette

Description will be given on a method of attaching the ink ribbon set 10 or the ink ribbon 13 to the ink cassette 40, with reference to the schematic views of FIGS. 12 and 13.

Initially, the ink cassette 40 and the supply container 70 with the ink ribbon set 10 stored therein are prepared. Then, the cover 71 of the supply container 70 is cut into two parts in a direction perpendicular to the longitudinal direction of the bobbins 11 and 12, and the two parts are stripped and opened from the cut in opposite directions along the length of the bobbins 11 and 12 (see FIG. 10). In this step, the stripping of the cover 71 is stopped when the entire opening of the container body 80 is exposed, and the two parts are not completely separated from the container body 80.

Opening the cover 71 causes the alignment marks 77 to appear. Since the marks 77 are affixed to the inner surface of the cover 71 in face-to-face relationship with the supply bobbin 11 as described above, a user can easily and reliably find which is the supply bobbin 11 by the marks 77. In view of such a function of the alignment marks 77, it is preferable that the marks 77 are provided near the opening end of the container body 80 in proximity to the supply bobbin 11 where it is easy for the user to notice the marks 77. Conversely, the alignment marks 77 may be provided on the container body 80 insofar as it is easy for the user to notice the marks 77. For example, the alignment marks 77 may be provided near the opening end of the container body 80 in proximity to the end portions 14 and 15 of the supply bobbin 11 or the ink ribbon 13 wound around the bobbin I1.

Figure 12:
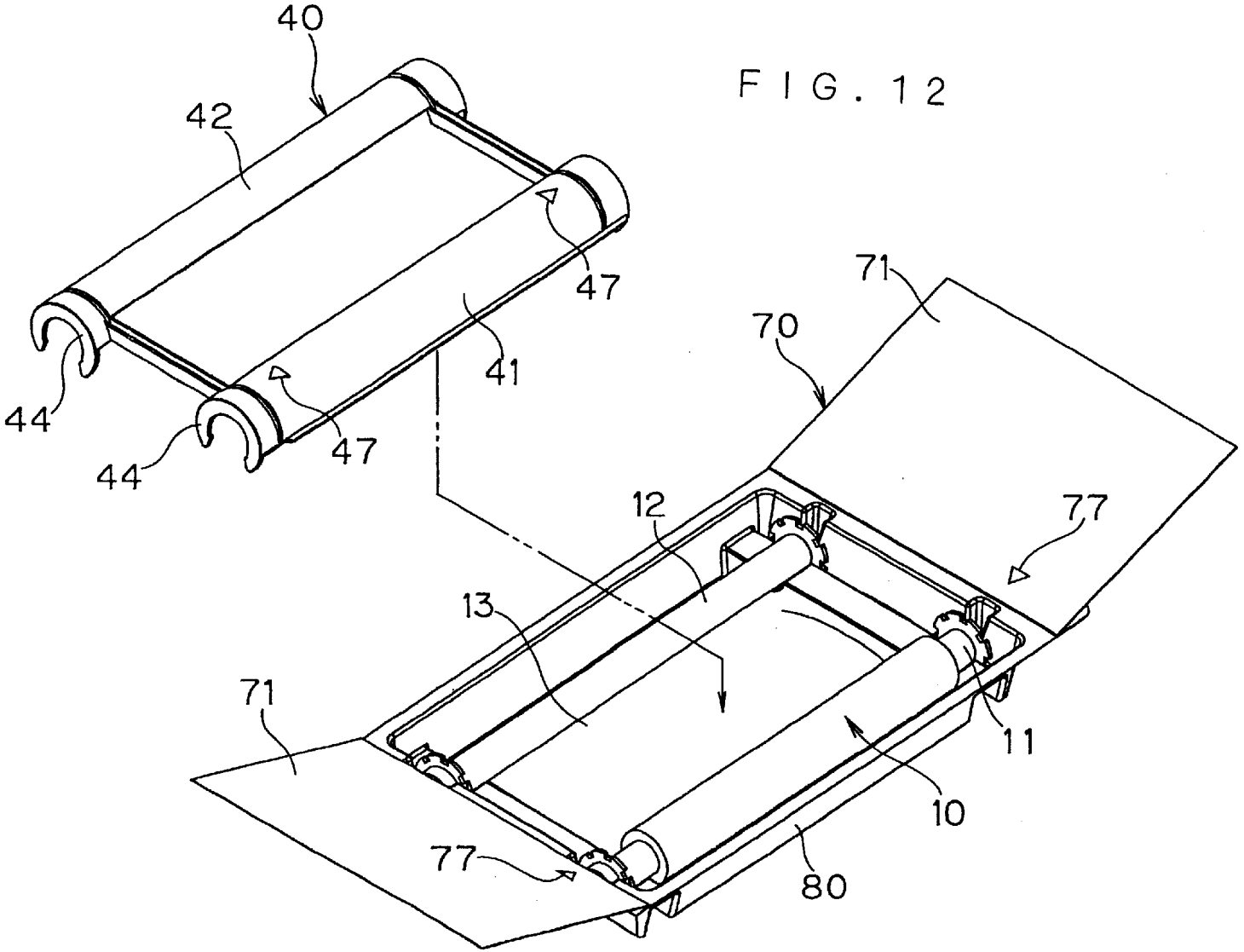
FIGS. 12 and 13 are schematic views for illustrating a method of attaching the ink ribbon to the ink cassette.

Next, as shown in FIG. 12, the ink cassette 40 is overlaid on the ink ribbon set 10, with the grooves 44*b* and 45*b* of the bobbin holders 44 and 45 oriented toward the ink ribbon set 10 in the supply container 70 and with the first and second parts 41 and 42 in face-to-face relationship with the supply and take-up bobbins 11 and 12, respectively. In particular, the grooves 44*b* and 45*b* of the respective bobbin holders 44 and 45 are brought into face-to-face relationship with the end portions 14 and 15 of the bobbins 11 and 12 in the container body 80, when the ink cassette 40 is overlaid on the ink ribbon set 10.

In this step, adjusting the orientation of the ink cassette 40 so that all of the alignment marks 47 and 77 are aligned along the first part 41 establishes the face-to-face relationships between the first part 41 and the bobbin 11 and between the second part 42 and the bobbin 12 easily and reliably. Additionally, the side parts 80*b* of the container body 80 guide the ink cassette 40 to allow the face-to-face relationships to be established easily and reliably between the grooves 44*b*, 45*b* and the corresponding end portions 14, 15 of the bobbins 11, 12.

Figure 13:
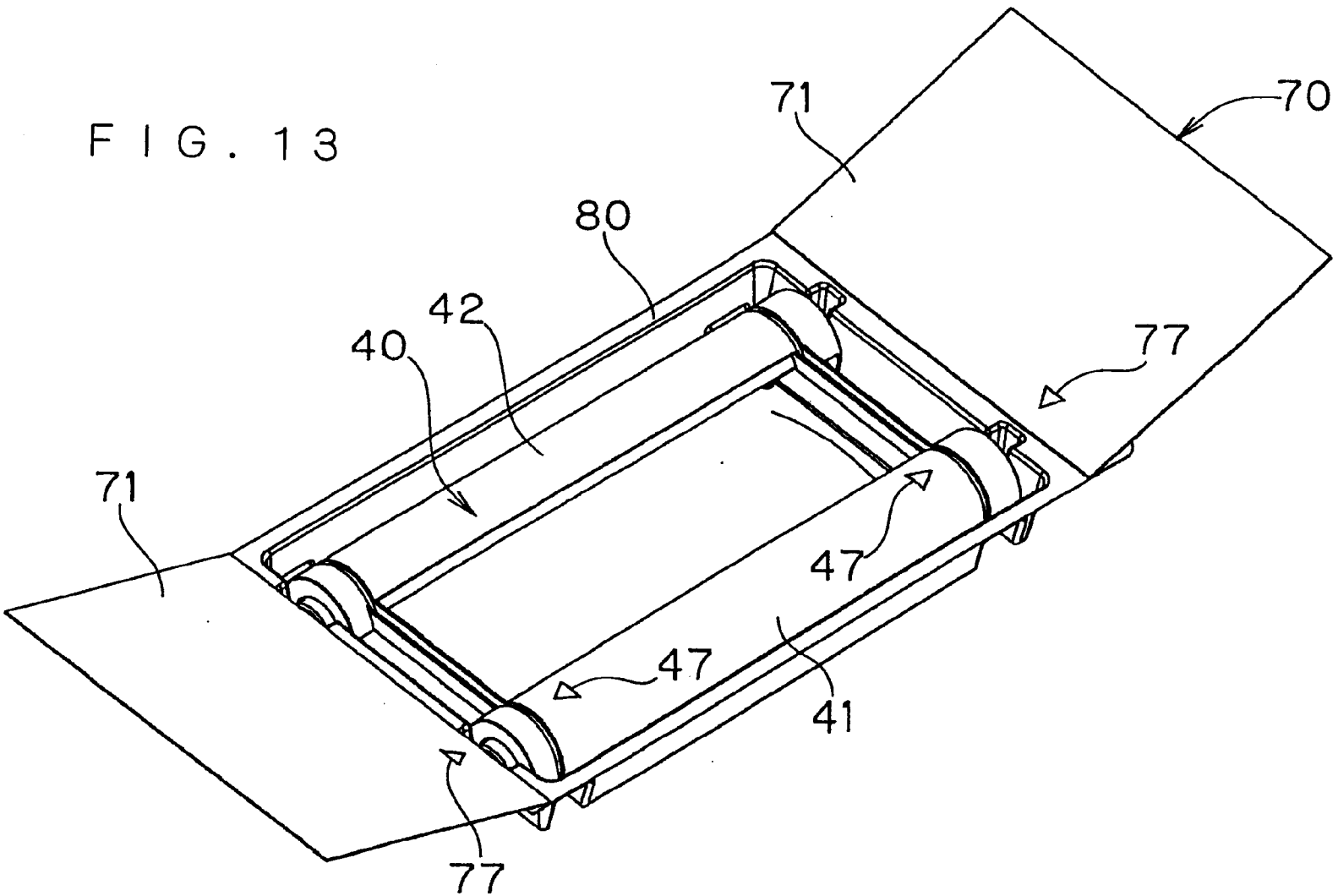
Figure 14:
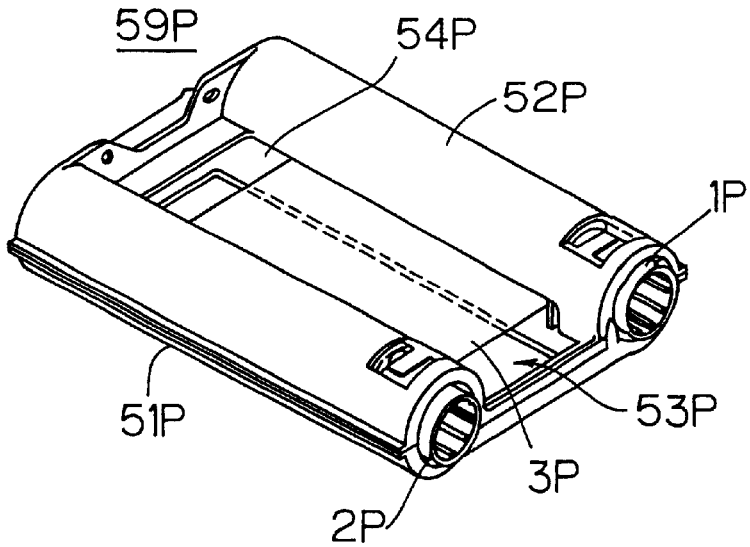
FIG. 14 is an external view of a conventional ink ribbon cartridge.
Figure 15:
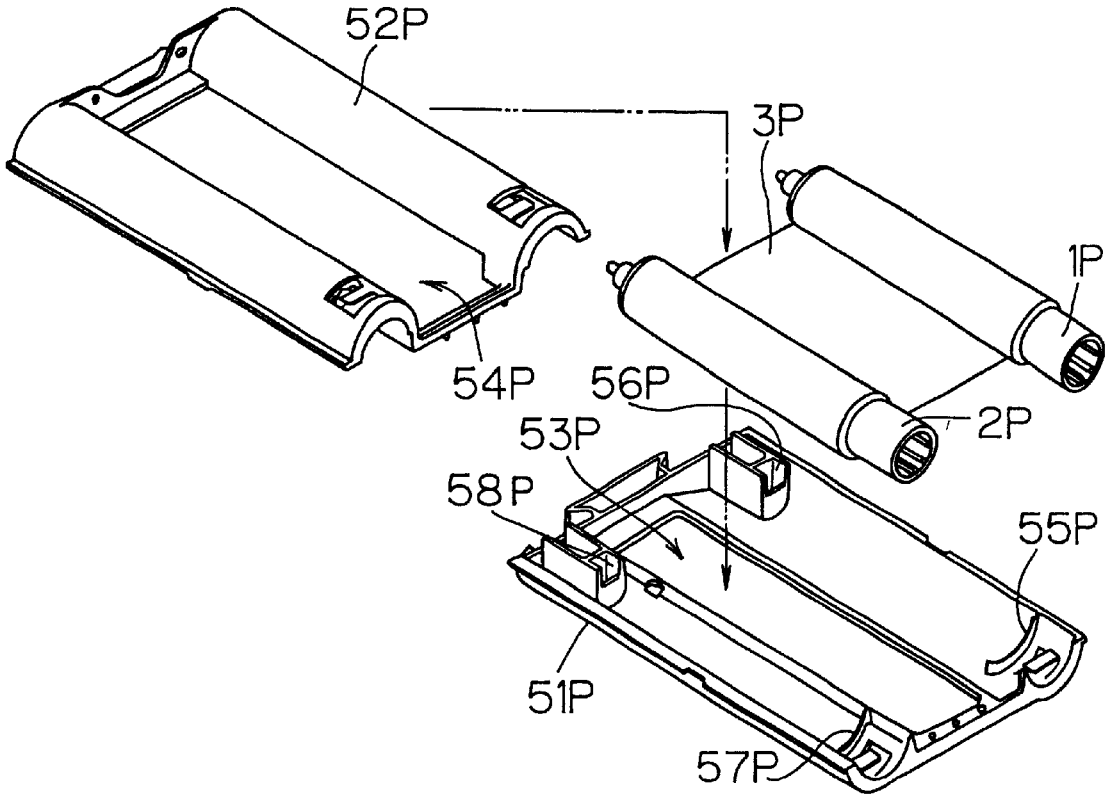
FIG. 15 is an exploded perspective view of the conventional ink ribbon cartridge.
Figure 16:
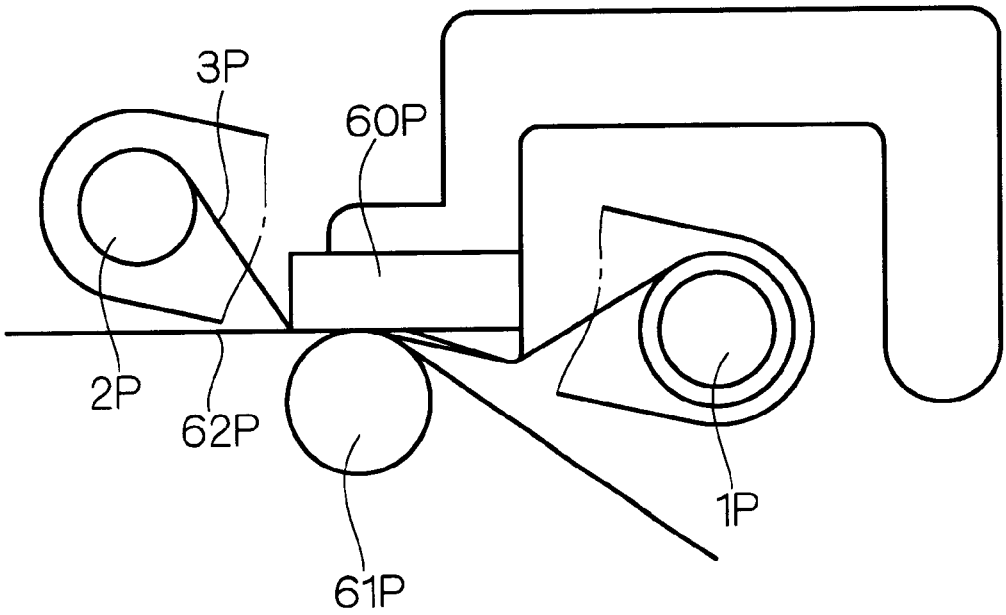
FIG. 16 is a schematic view for illustrating a thermal transfer printing method using an ink ribbon.

Then, pressure is applied to the ink cassette 40 toward the ink ribbon set 10 to insert the end portions 14 and 15 into the grooves 44*b* and 45*b*, respectively (see FIG. 13). In this step, because of the flexible property of the arms 44*a* and 45*a* which define the grooves 44*b* and 45*b*, the abutment of the end portions 14 and 15 against the protrusions 44*c* and 45*c* in the grooves 44*b* and 45*b* causes the arms 44*a* and 45*a* to deflect, thereby widening the grooves 44*b* and 45*b*. Thus, the end portions 14 and 15 are forced past the protrusions 44*c* and 45*c* into the bearing portions 44*d* and 45*d*. After the insertion of the end portions 14 and 15 in the bearing portions 44*d* and 45*d*, the arms 44*a* and 45*a* are restored to reliably hold the end portions 14 and 15 in the grooves 44*b* and 45*b*. Therefore, the bobbins 11 and 12 do not disengage from the grooves 44*b* and 45*b*.

The bobbins 11 and 12 are thus held by the bobbin holders 44 and 45. Therefore, taking the ink cassette 40 out of the supply container 70 achieves the simultaneous or integral dismounting of the ink cassette 40 and the ink ribbon set 10 from the supply container 70.

Thereafter, mounting the ink cassette 40 with the ink ribbon cassette 10 held therein into the printer enables printing to be performed using the ink ribbon 13. The ink ribbon 13 after use is removed from the printer integrally with the ink cassette 40.

Thus, the use of the ink cassette 40 and the ink ribbon supply container 70 facilitates and ensures the attachment of the ink ribbon set 10 or the ink ribbon 13 to the ink cassette 40.

As described above, the bobbin supports 81 and 82 support the bobbins 11 and 12 in parallel with each other in the position of the approximately equal depth in the container body 80, and the distance D10 between the axes of the bobbins 11 and 12 in the container body 80 is equal to the spacing D40 between the first and second parts 41 and 42. Additionally, the side parts 80*b* of the container body 80 guide the ink cassette 40. Therefore, the grooves 44*b* and 45*b* are placed into face-to-face relationship with the end portions 14 and 15 of the bobbins 11 and 12 easily and reliably only by loading the ink cassette 40 into the container body 80 and overlaying the ink cassette 40 on the ink ribbon set 10.

Further, since all of the grooves 44*b* and 45 extend (or are open) in the same direction, the bobbins 11 and 12 are simultaneously inserted into the grooves 44*b* and 45*b* only by forcing the ink cassette 40 toward the ink ribbon set 10 in the opening direction of the grooves 44*b* and 45*b*. This provides for improved workability.

Besides, the location and difference in width of the grooves 44*b* and 45*b* of the ink cassette 40 and, in addition, the marks 47 and 77 prevent the ink cassette 40 from being mounted in an improper orientation. The marks 47 provided on the opposite side of the opening of the grooves 44*b* and 45*b* and the marks 77 provided near the opening end of the container body 80 are easy to notice by the user, thereby facilitating and ensuring the mounting process. With this in view, alignment marks may be provided on the take-up bobbin 12 and the second part 42.

Moreover, the bobbin supports 81 and 82 support the ink ribbon 13 in the above-mentioned predetermined position within the supply container 70, thereby eliminating the need for the user to take the ink ribbon set 10 out of the supply container 70 and to grasp the ink ribbon set 10. In other words, the user can perform the attachment process without touching the ink ribbon.

Unlike the conventional ink ribbon cartridge 59P, the ink cassette 40 is advantageous in that, because of the removability of the ink ribbon set 10 after use from the ink cassette 40, the ink cassette 40 itself can receive a new ink ribbon set 10 attached thereto and be reused. This reduces the running costs of the printer. Furthermore, the use of the supply container 70 allows the supply of only the ink ribbon set 10, to reduce unwanted materials and the like enclosing the ink ribbon 13, thereby making the ink ribbon 13 available at low prices. From this point of view, the running costs are reduced.

<Modifications>

A difference may be made in width between the groove 45*b* of the first part 41 and the groove 45*b* of the second part 42. In an alternative or additional process, a difference may be made in the width of the groove 44*b* between the first and second parts 41 and 42. In other words, there may be a difference in width between at least one pair of grooves included among the two pairs of grooves (the pair of grooves 44*b* and the pair of grooves 45*b*) arranged in the direction in which the first and second parts 41 and 42 are arranged. Such a construction can also prevent the ink cassette from being mounted in an improper orientation.

While the invention has been described in detail, the foregoing description is in all aspects illustrative and not restrictive. It is understood that numerous other modifications and variations can be devised without departing from the scope of the invention.

What is claimed is:

1. An ink cassette for holding an ink ribbon set, said ink ribbon set having a pair of bobbins each including a rod-shaped body, and an ink ribbon having a first end fixed to one of said bobbins and a second end of said ink ribbon being wound around the other of said bobbins, said in cassette comprising:

a first part and a second part arranged in parallel with each other, each of said first and second parts including an elongate portion having bobbin holders for holding a corresponding one of said bobbins at respective longitudinal end portions in a longitudinal direction thereof, wherein each of said bob in holders includes a pair of arms, said pair of arms defining a linear groove extending in a direction intersecting said longitudinal direction, wherein all of said grooves re placed in the same orientation, whereby each of said bobbins is received in a corresponding pair of said grooves and held around its axis, and wherein said first part has an alignment mark affixed to an opposite side from an opening of said grooves.

2. The ink cassette according to claim 1, wherein each of said arms is flexible, and each of said grooves includes a portion having a width less than a diameter of a shaft of each of said bobbins.

3. An ink ribbon supply container for storing an ink ribbon set therein, said ink ribbon set having a pair of bobbins each including a rod-shaped body, and an ink ribbon having a first end fixed to one of said bobbins and a second end of said ink ribbon being wound around the other of said bobbins, said ink ribbon supply container comprising:

a container body recessed in shape and sized to allow an ink cassette to enter said recessed container body, wherein said ink cassette comprises: a first part and a second part arranged in parallel with each other, each of said first and second parts including an elongate portion having bobbin holders for holding a corresponding one of said bobbins at respective longitudinal end portions in a longitudinal direction thereof, wherein each of said bobbin holders includes a pair of arms, said pair of arms defining a linear groove extending in a direction intersecting said longitudinal direction, and wherein all of said grooves are placed in the same orientation, whereby each of said bobbins is received in a corresponding pair of said grooves and held around its axis, wherein said container body is recessed in shape and sized to allow said ink cassette to enter said recessed container body, with said ink cassette assuming a position such that a plane defined to include said elongate portions of said first and second parts is in face-to-face relationship with a bottom part of said recessed container body; and a first bobbin support and a second bobbin support both provided in said recessed container body for supporting said bobbins laid down in said recessed container body respectively and for supporting said bobbins in parallel with each other in a position of an approximately equal depth in said recessed container body.

4. The ink ribbon supply container according to claim 2, wherein a side portion of said recessed container body functions to guide said ink cassette so that said groove of each of said bobbin holders is in face-to-face relationship with a corresponding one of said bobbins supported by said first and second bobbin supports when said ink cassette assuming said position enters said container body.

5. A method of attaching an ink ribbon to an ink cassette, said ink ribbon being included in an ink ribbon set having a pair of bobbins each including a rod-shaped body, said ink ribbon having a first end fixed to one of said bobbins and a second end of said ink ribbon being wound around the other of said bobbins, said method comprising the steps of:

(a) preparing an ink cassette comprising: a first part and a second part arranged in parallel with each other, each of said first and second parts including an elongate portion having bobbin holders for holding a corresponding one of said bobbins at respective longitudinal end portions in a longitudinal direction thereof, wherein each of said bobbin holders includes a pair of arms, said pair of arms defining a linear groove extending in a direction intersecting said longitudinal direction, and wherein all of said grooves are placed in the same orientation, wherein each of said bobbins is received in a corresponding pair of said grooves and held around its axis;

(b) preparing said ink ribbon set stored in an ink ribbon supply container, wherein said ink ribbon supply container comprises: a container body recessed in shape and sized to allow said ink cassette to enter said recessed container body, with said ink cassette assuming a position such that a plane defined to include said elongate portions of said first and second parts is in face-to-face relationship with a bottom part of said recessed container body; and a first bobbin support and a second bobbin support both provided in said recessed container body for supporting said bobbins laid down in said recessed container body respectively and for supporting said bobbins in parallel with each other in a position of an approximately equal depth in said recessed container body;

(c) overlaying said ink cassette on said ink ribbon set, with said groove of each of said bobbin holders in face-to-face relationship with a corresponding one of said bobbins; and (d) applying pressure toward said ink ribbon set to said ink cassette to insert each of said bobbins into a corresponding pair of said grooves.

* * * * *

UNITED STATES PATENT AND TRADEMARK OFFICE

CERTIFICATE OF CORRECTION

PATENT NO. : 6,624,836 B2
DATED : September 23, 2003
INVENTOR(S) : Sakuta et al.

It is certified that error appears in the above-identified patent and that said Letters Patent is hereby corrected as shown below:

Title page, Item [54] and Column 1, lines 1-3,
Please change the title to read as follows:
-- INK CASSETTE, INK RIBBON SUPPLY CONTAINER, AND METHOD OF ATTACHING INK RIBBON TO INK CASSETTE --

Signed and Sealed this

Twenty-third Day of March, 2004

JON W. DUDAS
*Acting Director of the United States Patent and Trademark Office*